US005207041A

United States Patent [19]

Wills

[11] Patent Number: 5,207,041

[45] Date of Patent: May 4, 1993

[54] SERVICE WALL STRUCTURE

[75] Inventor: Tony Wills, London, England

[73] Assignee: Design Funktion Mobler AB, Atvidaberg, Sweden

[21] Appl. No.: 779,285

[22] Filed: Oct. 18, 1991

[30] Foreign Application Priority Data

Oct. 19, 1990 [SE] Sweden ..... 9003347

[51] Int. Cl.[5] ..... E04H 1/00

[52] U.S. Cl. ..... 52/220; 52/28; 52/239; 174/48; 454/185

[58] Field of Search ..... 52/220, 221, 302, 303, 52/808, 239, 28; 98/31; 174/48; 404/6

[56] References Cited

U.S. PATENT DOCUMENTS

| | | | |
|---|---|---|---|
| 1,718,252 | 6/1929 | Putnam | 52/220 |
| 1,718,254 | 6/1929 | Putnam | 52/220 |
| 3,391,507 | 7/1968 | Downing | 52/221 |
| 3,789,747 | 2/1974 | Wassnan et al. | 98/33 |
| 4,105,353 | 8/1978 | Bork et al. | 404/6 X |
| 4,571,906 | 6/1986 | Ashton | 52/221 X |
| 4,625,633 | 12/1986 | Martin | 52/239 X |
| 4,641,993 | 2/1987 | Hahne | 404/6 X |
| 4,685,255 | 8/1987 | Kelley | 52/221 X |
| 4,882,885 | 11/1989 | Chatterson et al. | 52/221 |
| 5,025,603 | 6/1991 | Johnson | 52/221 |

FOREIGN PATENT DOCUMENTS

| | | |
|---|---|---|
| 0027001 | 4/1981 | European Pat. Off. . |
| 0174426 | 3/1986 | European Pat. Off. . |
| 0200514 | 11/1986 | European Pat. Off. . |
| 2158937 | 3/1974 | Fed. Rep. of Germany . |
| 2433283 | 3/1976 | Fed. Rep. of Germany . |
| 2438502 | 3/1976 | Fed. Rep. of Germany . |
| 2637642 | 4/1990 | France . |
| WO8911572 | 11/1989 | PCT Int'l Appl. . |
| 2127139 | 4/1984 | United Kingdom . |

*Primary Examiner*—Richard E. Chilcot, Jr.
*Assistant Examiner*—Robert J. Canfield
*Attorney, Agent, or Firm*—Cushman, Darby & Cushman

[57] ABSTRACT

A service wall constructed from at least two mutually connectable and free-standing wall-sections. Each section includes at least two mutually separate cable channels which extend in the longitudinal direction of the section and which are intended to accommodate electric cables, telecommuncation cables and data communication cables. The wall-section also includes a ventilation channel which extends in the longitudinal direction of the section and which is separate from the cable channels.

7 Claims, 3 Drawing Sheets

SERVICE WALL STRUCTURE

BACKGROUND OF THE INVENTION

The present invention relates to a service wall structure which comprises two mutually connectable, freely-standing wall-sections.

It has earlier been common practice to divide large areas, such as office areas, into smaller working areas with the aid of screening walls. Although this enables the areas concerned to be utilized with greater flexibility, this subdivision of present-day office spaces often necessitates the troublesome installation of a large number of electrical cables for the supply of electricity, and for telecommunication and computer communication purposes. As a result, a large number of cables are often laid along the screening walls, more or less freely over some areas. The present-day use of a large number of electrical apparatus and computers also results in the generation of high levels of heat in the working areas concerned, and when moveable screening walls are used, it is also difficult to achieve satisfactory ventilation and to remove effectively excess heat from each working area.

SUMMARY OF THE INVENTION

The object of the present invention is to provide a screening wall construction with which the aforesaid drawbacks associated with earlier known screening walls are avoided.

BRIEF DESCRIPTION OF THE DRAWINGS

The invention will now be described in more detail with reference to a non-limiting exemplifying embodiment thereof illustrated in the accompanying drawings, in which.

DETAILED DESCRIPTION

Figure 1:
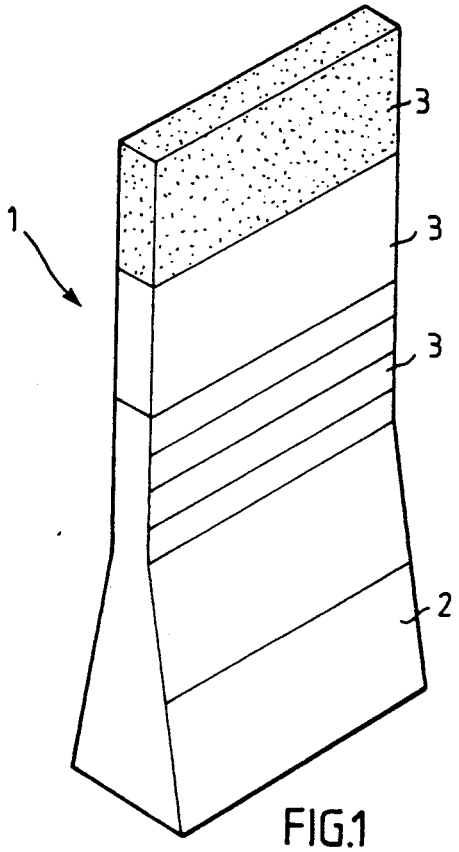
FIG. 1 is a schematic, perspective view of a section of a service wall or screen constructed accordance with the invention.

FIG. 1 illustrates a wall-section 1 for use in a service wall constructed in accordance with the invention. In use, several such wall-sections are connected end-to-end. Although the wall-sections may have a configuration which varies slightly from wall-section to wall-section, all of the wall-sections comprise a base-part 2 which is broadest nearest the floor and which tapers upwards to a given height, above which the wall-section comprises generally straight wall-parts 3 of constant thickness, as illustrated in FIG. 1. The base-part 2 may appropriately have a height which corresponds to the height of a standard desk, i.e. a height of about 700 mm.

Figure 2:
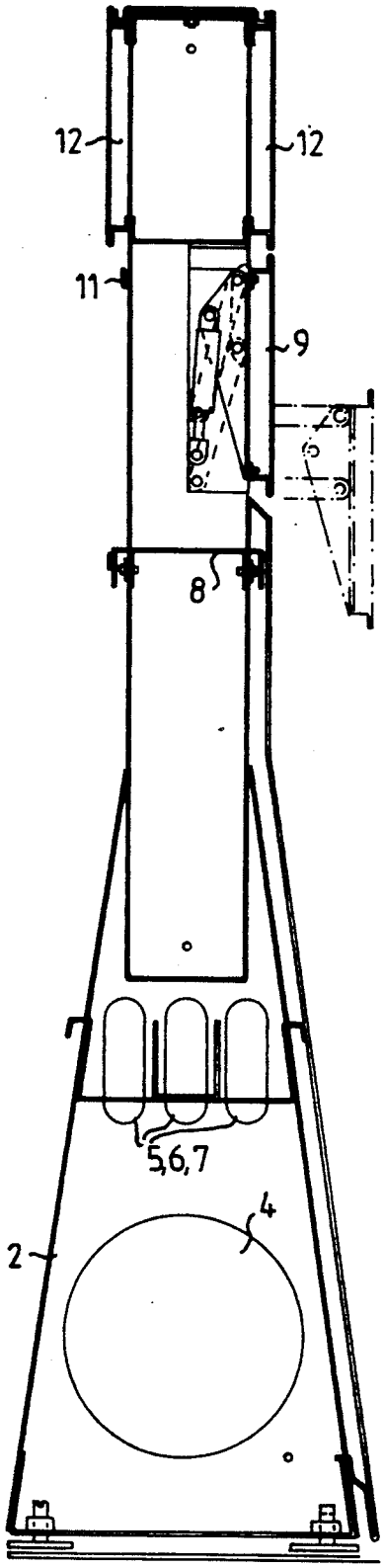
FIG. 2 is a schematic cross-sectional view of an inventive service wall-section taken vertically.

FIG. 2 is a cross-sectional view taken vertically through a wall-section 1. As shown, there is provided at the bottom of the base-part 2 a cavity which accommodates a ventilation channel 4 which extends along the bottom of the base-part 2, i.e. in the longitudinal direction of the wall-section. Arranged above the ventilation-channel cavity in the base-part 2 are three mutually separated cable channels 5, 6, 7, which also extend through the wall-section 1 in its longitudinal direction. These cable channels 5, 6, 7 are intended to accommodate electrical cables, telecommunication cables and data communication cables, each separated from the other in a respective channel 5, 6, 7. Mounted in the straight part of the wall-part 3 above the cable channels 5, 6, 7 is a profiled bar 8, which also extends in the longitudinal direction of the wall-sections and which is intended to support electric connectors to which the cables in the cable channel 5, 6, 7 can be connected. In order to provide access to the electrical connectors and the profiled bar 8, there is mounted above the bar in the straight part of the wall-part 3 a pivotal flap 9 through which access can be had to the interior of the wall-part 3 of the respective wall-section and enable external apparatus to be connected to the electrical connectors mounted on the profiled bar 8.

A ventilation opening connected to the ventilation channel 4 in the bottom of the wall-section may be provided in the straight wall-part 3, above the flap or hatch 9 in the upper part of the wall-section 1. As an alternative to central ventilation, there may be provided a personal comfort unit which includes a fan by means of which ventilation in the working area concerned can be controlled.

Figure 3:
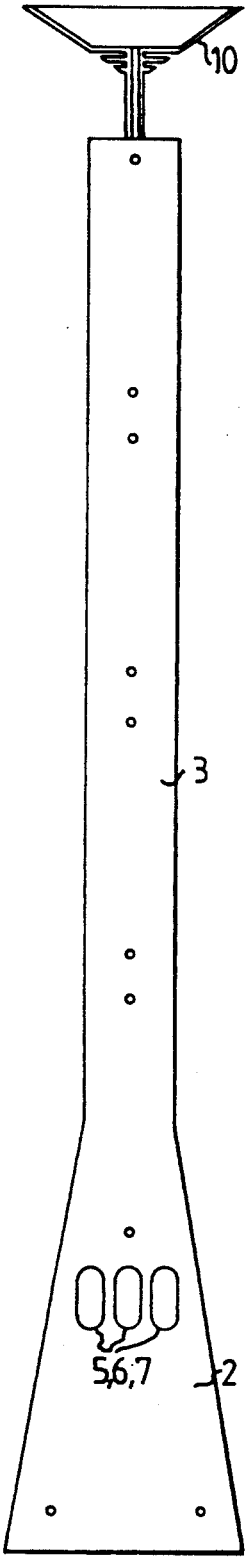
FIGS. 3, 4 and 5 are schematic views of the end wall-sections of an inventive wall structure, taken at mutually different heights.
Figure 4:
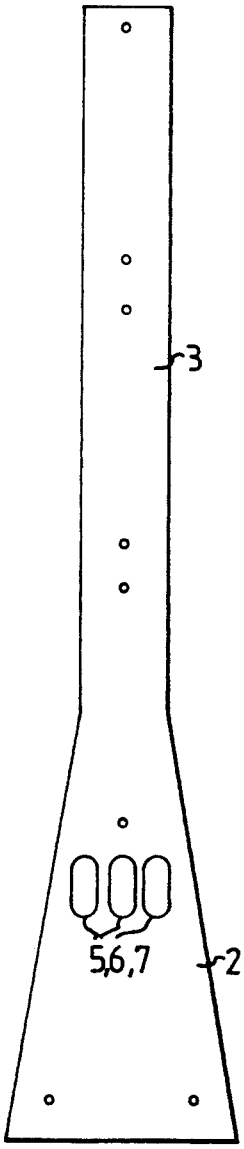
Figure 5:
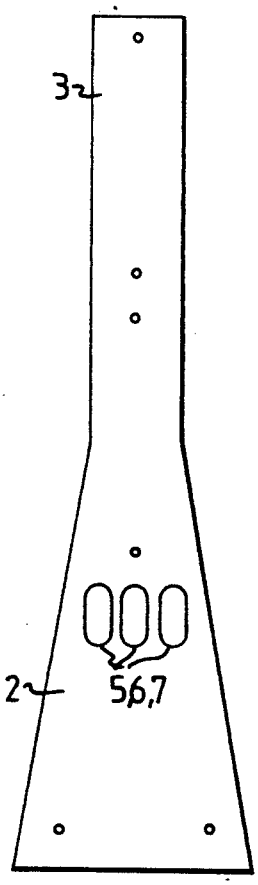

As illustrated in FIG. 3, a fixture for the connection of a lamp fitting 10 may also be mounted in the upper part of the straight wall-part 3 of the wall-section 1.

Support profiles and the like for supporting computer equipment, such as a display screen, for example, may be mounted in the straight wall-parts 3.

The wall-parts are also preferably provided with fittings 11 on which cladding panels 12 can be mounted, so as to cover the longitudinally extending sides of the wall-sections. Correspondingly, further cladding panels may be fitted to the end walls of the wall-sections.

Figure 6:
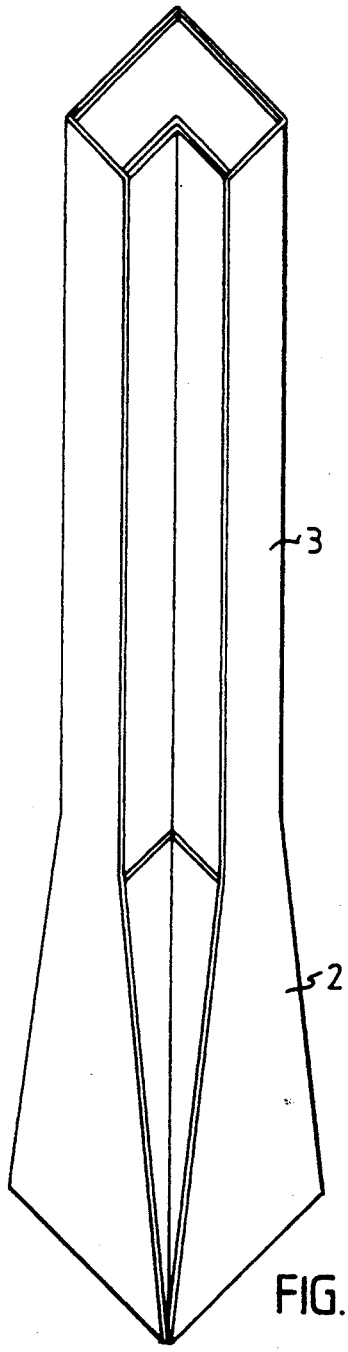
FIG. 6 is a schematic, perspective view of a corner section of the inventive service wall structure.

FIG. 6 illustrates the construction of a corner section for connection to the wall-sections 1, thereby to enable an angled service wall to be constructed. The corner section also includes channels for ventilation and cables corresponding to those provided in the straight wall-sections 1.

I claim:

1. A free-standing wall section for a service wall of an indoor working area, comprising:

wall means providing a bottom wall, a top wall, two opposite side walls and two opposite end walls;

said end walls being substantially vertical, so that side wall section can be ranked end-to-end with like wall sections to provide a service wall, in which said wall section has a longitudinal direction which extends horizontally from one of said end walls to the other of said end walls;

said end walls being broadest adjacent said bottom walls, and tapering upwardly to a level which is intermediate said top wall and said bottom wall; said side walls being upwardly convergent from said bottom wall to said level, and being generally uniformly spaced from one another from said level up to said top wall;

means defining a longitudinally extending ventilation channel cavity within said wall section, communicating between said end walls below said level;

means defining at least two cable distribution channels within said wall section, communicating between said end walls below said level; said cable distribution channels being internally separated from one another and from said ventilation channel cavity;

said bottom wall being arranged to be supported on a floor of a building.

2. The free-standing wall section of claim 1, wherein:

said at least two cable distribution channels include an electrical cable distribution channel, a telecommunication cable distribution channel, and a data communication cable distribution channel.

3. The free-standing wall section of claim 1, wherein:

at least one said side wall includes an openable and closeable flap for providing access to a space defined within said wall section;

a profiled bar extending longitudinally of said wall section within said space below said flap but above said cable distribution channels, said profiled bar being arranged to support cable connectors for cables distributed through said cable distribution channels.

4. The free-standing wall section of claim 1, further including a lamp fitting provided on said top wall.

5. The free-standing wall section of claim 1, further comprising:

at least one cladding panel externally hooked onto at least one of said side walls.

6. The free-standing wall section of claim 1, wherein:

said top, bottom, side and end walls are made of sheet material, so as to enclose an internal space through which said cavity and said channels extend.

7. The free-standing wall section of claim 1, wherein:

said level is located about 700 mm above said bottom wall.

* * * * *